US007192511B2

(12) United States Patent
Bonnardel et al.

(10) Patent No.: US 7,192,511 B2
(45) Date of Patent: Mar. 20, 2007

(54) METHOD FOR REGULATING AN ELECTROLYTIC CELL

(75) Inventors: Oliver Bonnardel, Saint Martin D'arc (FR); Claude Vanvoren, Saint Jean de Maurienne (FR)

(73) Assignee: Aluminum Pechiney, Paris (FR)

( * ) Notice: Subject to any disclaimer, the term of this patent is extended or adjusted under 35 U.S.C. 154(b) by 385 days.

(21) Appl. No.: 10/467,483

(22) PCT Filed: Feb. 26, 2002

(86) PCT No.: PCT/FR02/00692

§ 371 (c)(1),
(2), (4) Date: Feb. 20, 2004

(87) PCT Pub. No.: WO02/068725

PCT Pub. Date: Sep. 6, 2002

(65) Prior Publication Data

US 2004/0168930 A1 Sep. 2, 2004

(30) Foreign Application Priority Data

Feb. 28, 2001 (FR) ..... 01 02723

(51) Int. Cl.
*C25C 3/20* (2006.01)

(52) U.S. Cl. ..... 205/336; 205/337; 205/372; 205/374; 205/392; 205/394; 205/396

(58) Field of Classification Search ..... 205/372, 205/374, 392, 394, 396, 336, 337; 204/243.1, 204/247.4
See application file for complete search history.

(56) References Cited

U.S. PATENT DOCUMENTS 3,900,371 A * 8/1975 Chaudhuri ..... 205/336
4,446,350 A 5/1984 Mizukawa et al.
5,094,728 A 3/1992 Entner
6,183,620 B1 2/2001 Verstreken

FOREIGN PATENT DOCUMENTS

| | | |
|---|---|---|
| CN | 1006307 | 12/1988 |
| RU | 2106435 | 3/1998 |
| SU | 1724713 | 4/1992 |
| WO | WO 99/41432 | 8/1999 |

OTHER PUBLICATIONS

Ketil A. Rye: "Dynamic Ledge Response in Hall-Heroult Cells", Light Metals, 1999, pp. 347-352.
Peter M. Entner: "Control of $AlF_3$ Concentration", Light Metals, 1992, pp. 369-374.
M. J. Wilson: "Practical Considerations Used in the Development of a Method for Calsulating Aluminium Fluoride Additions Based on Cell Temperatures", Light Metals, 1992, pp. 375-378.

* cited by examiner

*Primary Examiner*—Bruce F. Bell
(74) *Attorney, Agent, or Firm*—Susan E. Shaw McBee

(57) ABSTRACT

The invention relates to a regulation method for an electrolytic cell for the production of aluminium by means of reduction of alumina dissolved in a molten cryolite bath, wherein a solidified bath ridge is formed on the internal walls of the pot, a quantity B, referred to as the "ridge variation indicator", which is sensitive to the variation of said solidified bath ridge, is determined and at least one of the setting means of the pot (such as the anode-metal distance) and/or at least one control operation (such as the addition of $AlF_3$) is modified as a function of the value obtained for said indicator. The indicator may be determined from electrical measurements on the pot and/or from measurements of the liquid metal surface area. The method according to the invention makes it possible to regulate an electrolytic cell effectively at currents of up to 500 kA with an electrolyte bath with an $AlF_3$ content greater than 11% and reduce the number of $AlF_3$ content measurements in the bath considerably.

59 Claims, 7 Drawing Sheets

METHOD FOR REGULATING AN ELECTROLYTIC CELL

The present application is a National Stage Application of PCT/FR02/00692 filed Feb. 26, 2002, which claims priority to French Application No. 01/02723 which was filed Feb. 28, 2001.

FIELD OF THE INVENTION

The invention relates to a regulation method for an aluminium production cell by means of electrolysis of alumina dissolved in an electrolyte based on molten cryolite, particularly according to the Hall-Héroult method.

STATE OF THE ART

Metal aluminium is produced industrially by igneous electrolysis, i.e. by means of electrolysis of alumina in solution in a molten cryolite bath, referred to as an electrolyte bath, particularly according to the well-known Hall-Héroult method. The electrolyte bath is contained in pots, referred to as "electrolytic pots", comprising a steel shell, which is lined internally with refractory and/or insulating materials, and a cathode assembly located at the base of the pot. Anodes made of carbonaceous materials are partially immersed in the electrolyte bath. The assembly formed by an electrolytic pot, its anode(s) and the electrolyte bath is referred to as an electrolytic cell.

The electrolytic current, which flows in the electrolyte bath and the pad of liquid aluminium via the anodes and cathode components, brings about the aluminium reduction reactions and also makes it possible to maintain the electrolyte bath at a temperature of the order of 950° C. by means of the Joule effect. The electrolytic cell is regularly supplied with alumina so as to compensate for the alumina consumption produced by the electrolytic reactions.

The productivity and current efficiency of an electrolytic cell are influenced by several factors, such as the intensity and distribution of the electrolytic current, the pot temperature, the dissolved alumina content and the acidity of the electrolyte bath, etc., which interact with each other. For example, the melting temperature of a cryolite bath decreases with the excess aluminium trifluoride ($AlF_3$) with reference to the nominal composition (3 $NaF.AlF_3$). In modem plants, the operating parameters are adjusted to aim for current efficiencies of over 90%.

However, the effective current efficiency of a cell is significantly influenced by variations in said cell's parameters. For example, an increase in the electrolyte temperature by around ten degrees Celsius may cause the current efficiency to fall by approximately 2% and a decrease in the electrolyte temperature by around ten degrees Celsius may reduce the already low solubility of alumina in the electrolyte and favour the "anode effect", i.e. anode polarisation, with a sudden rise in the voltage at the cell terminals and the release of a large quantity of fluorinated and fluoro-carbonated products, and/or insulating deposits on the cathode surface.

Therefore, the operation of an electrolytic cell requires precise control of its operating parameters, such as its temperature, alumina content, acidity, etc., so as to maintain them at determined set-point values. Several regulation methods have been developed to achieve this objective. These methods generally relate to the regulation of the alumina content of the electrolyte bath, the regulation of its temperature, or the regulation of its acidity, i.e. the excess $AlF_3$.

Statement of the Problem

Aluminium producers, in the continuous aim to increase electrolytic plant production and productivity at the same time, try to push back these limits.

In particular, in order to increase plant productivity, it is aimed to reach current efficiencies above 95% operating with $AlF_3$ excesses of over 11%, and which may reach 13 to 14%, which makes it possible to decrease the cell operating temperature (the liquidus temperature drops approximately 5° C./% $AlF_3$) and, as a result, reduce the energy consumption of said cells. However, in this chemical composition range, the solubility of alumina is considerably reduced, which increases the risks of anode effects and forming of insulating deposits on the cathode.

In addition, in order to increase plant production, it is aimed to increase the unit capacity of cells and, in correlation, increase the intensity of the electrolytic current. The current trend is to develop electrolytic cells with a current greater than or equal to 500 kA. The increase in the capacity of electrolytic cells may be obtained, as a general rule, either by increasing the permissible intensity of cells of known type or existing cells, or by developing very large cells. In the first case, the increase in the permissible intensity results in a decrease in the electrolyte bath mass, which exacerbates the instability effect. In the second case, the increase in the cell size increases their thermal and chemical inertia. Consequently, the increase in cell capacity not only increases the rate of alumina consumption but also amplifies instability generation and cell deviation phenomena, which increases difficulties in controlling electrolytic cells.

Therefore, the applicant searched for a regulation method for an electrolytic cell, particularly of the electrolyte bath acidity (i.e. its $AlF_3$ content) and the overall thermics of the cell, which makes it possible to control, in a stable manner with a current efficiency greater than 93%, or even greater than 95%, without having to use frequent $AlF_3$ content measurements, electrolytic cells wherein the excess $AlF_3$ is greater than 11% and wherein the current may be greater than or equal to 500 kA.

DESCRIPTION OF THE INVENTION

The invention relates to a regulation method for an electrolytic cell intended for the production of aluminium by means of igneous electrolysis, i.e. by flowing current in an electrolyte bath based on molten cryolite and containing dissolved alumina, particularly according to the Hall-Héroult method.

The regulation method according to the invention comprises the addition of alumina in the electrolyte bath of an electrolytic cell, and is characterised in that it comprises the determination of a quantity B, referred to as the "ridge variation indicator", which is sensitive to variations of the solidified bath ridge formed on the side walls of the pot, and the modification of at least one of the setting means of the pot and/or at least one control operation as a function of the value obtained for said indicator.

The applicant noted that, surprisingly, accounting for the variation in the solidified bath mass in the regulation of an electrolytic pot made it possible to reduce the amplitude and dispersion of the fluctuations of the pot operating parameters, such as its acidity.

According to one embodiment of the invention, said indicator is determined from an electrical measurement on the electrolytic cell which is capable of detecting variations in the current lines induced by the variation of the ridge. In a preferred embodiment of the invention, said indicator is determined from a quantity referred to as the "specific resistance variation" ΔRS which is determined from the resistance R of the electrolytic cell.

According to another embodiment of the invention, said indicator is determined from a determination of the surface area of the liquid metal pad, which is capable of detecting variations in the surface area of the liquid metal induced by the variation of the ridge.

According to another embodiment of the invention, said indicator is determined from a combination of electrical measurements and measurements of the metal surface area.

The invention may be implemented advantageously in electrolyte bath acidity regulation. In particular, the regulation method according to the invention may comprise the addition, in the electrolyte bath of an electrolytic cell, during pre-determined time intervals p referred to as "regulation periods", of a quantity Q(p) of aluminium trifluoride ($AlF_3$) determined by the sum of at least one basic term Qo(p) corresponding to the net average $AlF_3$ requirements of the cell, and of a corrective term Qi(p) including at least one term Qsol(p), referred to as the "ridge term", which is determined from at least one ridge variation indicator. Therefore, the quantity Q(p) is determined using the formula: Q(p)=Qo(p)+Qi(p)=Qo(p)+Qsol(p)+ . . .

The applicant noted that the ridge term Qsol(p) makes it possible to reduce the number of analyses of the $AlF_3$ content of the liquid electrolyte bath significantly; these measurements add to cell operating costs and are, in any case, usually affected by significant errors.

Said modifications of at least one cell setting means and/or at least one control operation may advantageously be combined.

FIGURES

Figure 1:
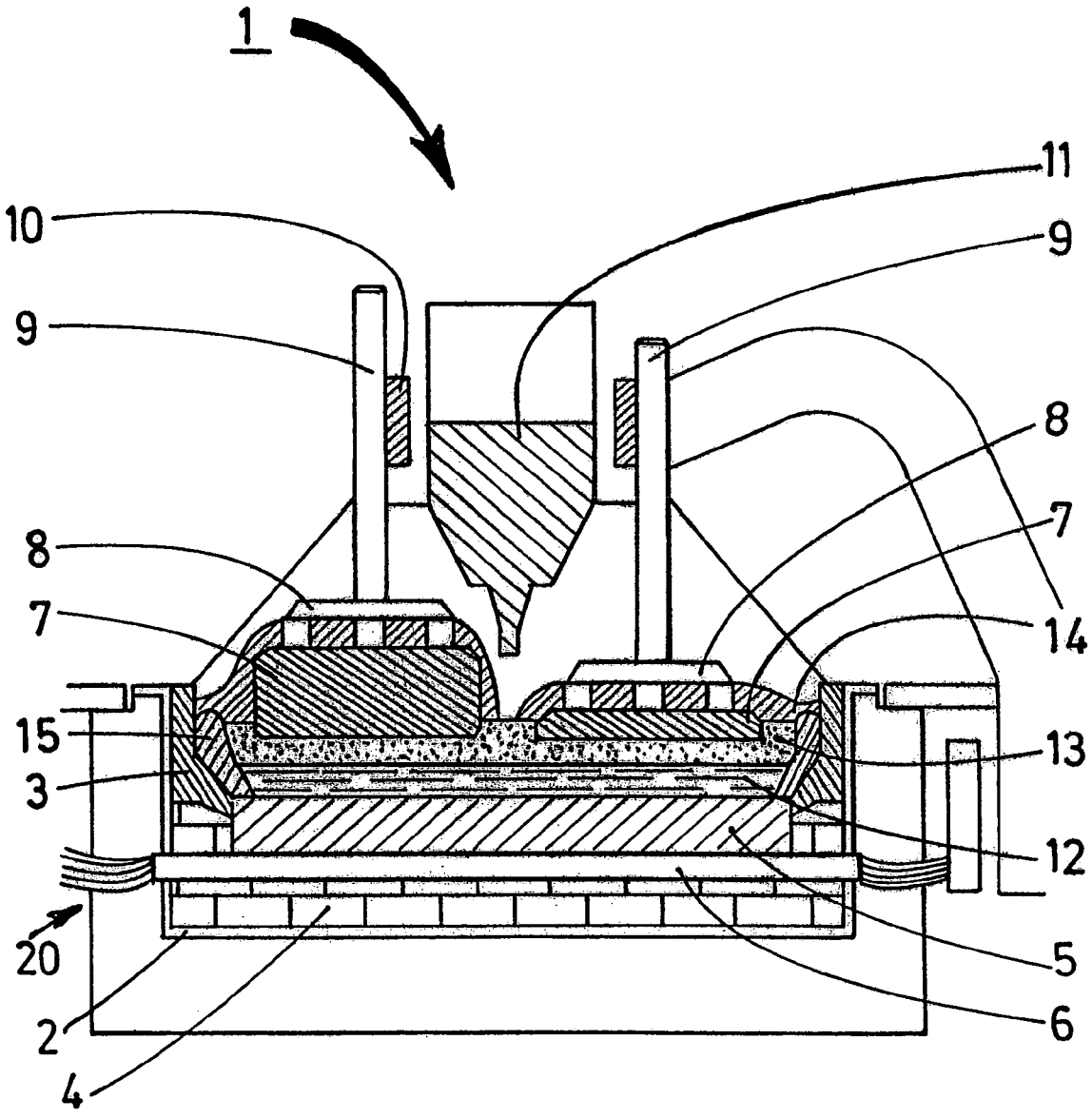
FIG. 1 represents, in a transverse section, a typical electrolytic cell.

As illustrated in FIG. 1, an electrolytic cell 1 for the production of aluminium by means of the Hall-Héroult electrolysis method typically comprises a pot 20, anodes 7 supported by attachment means 8, 9 to an anode frame 10 and alumina supply means 11. The pot 20 comprises a steel shell, internal lining components 3, 4 and a cathode assembly 5, 6. The internal lining components 3, 4 are generally blocks made of refractory materials, which may be heat insulators. The cathode assembly 5, 6 comprises connection bars 6 to which the electric conductors used to route the electrolytic current are attached.

The lining components 3, 4 and the cathode assembly 5, 6 form, inside the pot 20, a crucible capable of containing the electrolyte bath 13 and a liquid metal pad 12 when the cell is in operation, during which the anodes 7 are partially immersed in the electrolyte bath 13. The electrolyte bath contains dissolved alumina and, as a general rule, an alumina cover 14 covers the electrolyte bath.

The electrolytic current transits in the electrolyte bath 13 via the anode frame 10, the attachment means 8, 9, anodes 7 and cathode components 5, 6. The purpose of the alumina supply to the cell is to compensate for the approximately continuous consumption of the cell which is essentially due to the reduction of alumina into metal aluminium. The alumina supply, which is made by adding alumina into the liquid bath 13 is generally regulated separately.

The metal aluminium 12 which is produced during the electrolysis is accumulated at the bottom of the cell and a relatively clear interface between the liquid metal 12 and the molten cryolite bath 13 is established. The position of this bath-metal interface varies over time: it rises as the liquid metal accumulates at the bottom of the cell and it goes down when the liquid metal is removed from the cell.

Several electrolytic cells are generally arranged in a row, in buildings referred to as electrolysis rooms, and connected electrically in series using connection conductors. The cells are typically arranged so as to form two or more parallel lines. The electrolytic current thus flows in cascade from one cell to the next.

DETAILED DESCRIPTION OF THE INVENTION

According to the invention, the regulation method for an electrolytic cell 1 for the production of aluminium by means of electrolytic reduction of alumina dissolved in an electrolyte bath 13 based on cryolite, said cell 1 comprising a pot 20, at least one anode 7, at least one cathode component 5, 6, said pot 20 comprising internal side walls 3 and being capable of containing a liquid electrolyte bath 13, said cell 1 comprising at least one setting means of said cell including a mobile anode frame 10 to which said at least one anode 7 is attached, said cell 1 being capable of circulating a so-called electrolytic current in said bath, said current having an intensity I, the aluminium produced by means of said reduction forming a pad referred to as a "liquid metal pad" 12 on said cathode component(s) 5, 6, said cell 1 comprising a solidified bath ridge 15 on said walls 3, comprises control operations of said cell including the addition of alumina and the addition of $AlF_3$ in said bath and is characterised in that it comprises:

- the determination of the value of at least one indicator B referred to as the "ridge variation", capable of detecting the variation of said solidified bath ridge 15;
- the adjustment of at least one setting means and/or at least one control operation according to the value obtained for the or each ridge variation indicator.

Variations in the solidified bath ridge are generally conveyed by variations in the thickness and, to a lesser degree, the shape of said ridge.

Said adjustment of at least one setting means of the cell typically comprises at least one modification of the position of said mobile anode frame 10, either upwards, or downwards, so as to modify the anode/metal distance (AMD).

Said at least one control operation typically comprises the addition of a quantity Q of $AlF_3$ into said electrolyte bath 13. Said adjustment may then comprise at least one modification of said quantity Q as a function of the value obtained for one or each ridge variation indicator.

In a preferred embodiment of the invention, the regulation method is characterised in that said at least one ridge variation indicator includes an indicator, referred to as "BE", which is determined from at least one electrical measurement on said cell 1 capable of detecting the variations of the current lines induced by the variation of said ridge. Preferentially, said indicator BE is determined from at least one determination of said intensity I and at least one determination of the drop in voltage U at the terminals of said cell 1.

In an alternative version of this embodiment, said at least one ridge variation indicator BE is equal to a specific resistance variation ΔRS which may be determined using a measurement method comprising:

- the determination of at least one first value I1 for said intensity I and at least one first value U1 for the drop in voltage U at the terminals of said cell 1;
- the calculation of a first resistance R1 from at least said values I1 and U1;
- the movement of the anode frame 10 by a determined distance ΔH, from a so-called initial position, either upwards (ΔH being positive in this case), or downwards (ΔH being negative in this case);
- the determination of at least one second value I2 for said intensity I and at least one second value U2 for the drop in voltage U at the terminals of said cell 1;
- the calculation of a second resistance R2 from at least said values I2 and U2;
- the calculation of a resistance variation ΔR using the formula ΔR=R2−R1;
- the calculation of said specific resistance ΔRS using the formula ΔRS=ΔR/ΔH.

Preferentially, the measurement method also comprises (at least after the determination of the values of I1, I2, U1 and U2), the movement of the anode frame 10 so as to return it to its initial position and restore the initial cell setting.

Said first and second resistance R1 and R2 may be calculated using the formula R=(U−Uo)/I, where Uo is a constant typically between 1.6 and 2.0 V. For example, R1 and R2 may be given by R1=(U1−Uo)/I1 and R2=(U2−Uo)/I2. According to an alternative embodiment of the invention, R1 and R2 may be given by a mean value obtained from a determined number of values of the voltage U and intensity I.

In practice, it was found to be simpler to give an order of movement of the anode frame 10 for a determined time and measure the resulting frame displacement ΔH.

According to this embodiment of the invention, the regulation method advantageously comprises:

- the determination of a specific resistance variation ΔRS using the formula: ΔRS=ΔR/ΔH;
- the adjustment of at least one control means and/or at least one control operation using a determined function of said specific resistance variation ΔRS.

Said adjustment may be a determined function of the difference between said specific resistance variation ΔRS and a reference value ΔRSo, i.e. ΔRS−ΔRSo.

Figure 5:
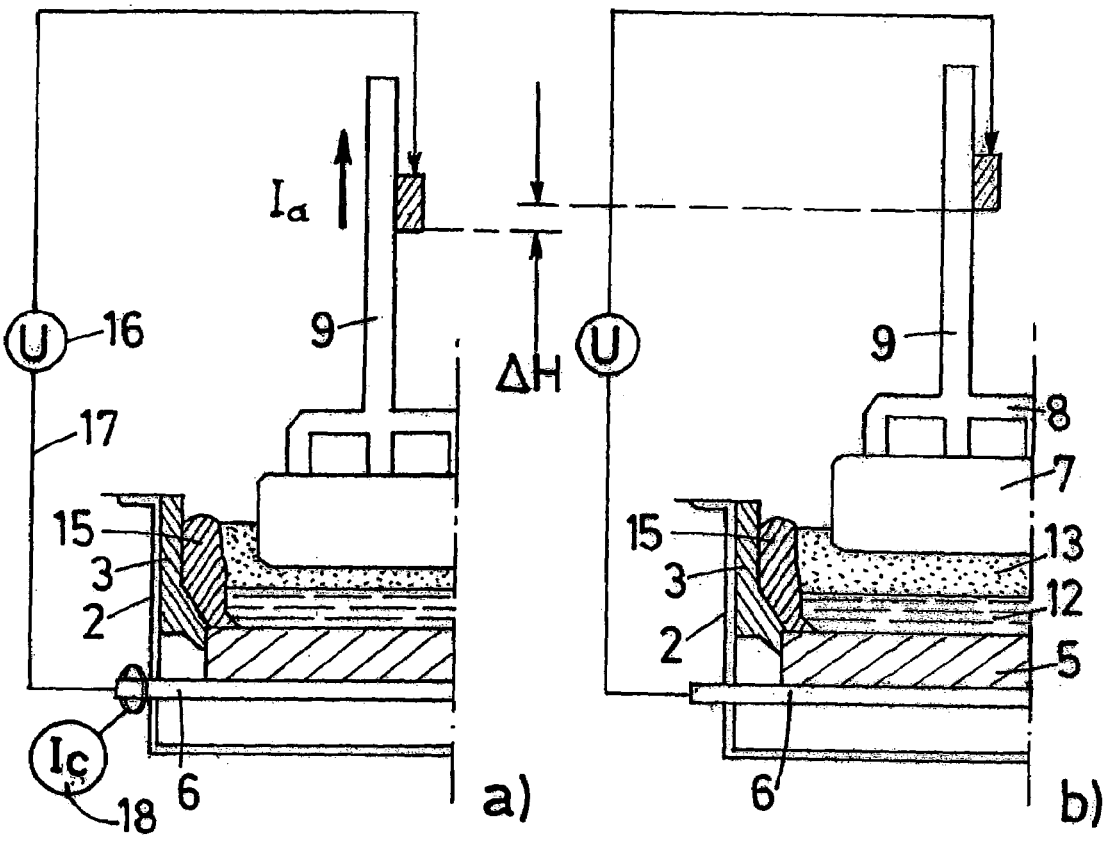
FIG. 5 illustrates a method to determine the specific electric resistance variation of the electrolytic cell.

As shown in FIG. 5, said resistance is typically measured using means 18 to measure the intensity I of the current circulating in the cell (where I is equal to the sum of the cathode currents Ic or anode intensity Ia) and means 16,17 to measure the resulting drop in voltage U at the cell terminals (typically the resulting drop in voltage between the anode frame and the cathode components of the cell). Said resistance R is generally calculated using the equation: R=(U−Uo)/I, where Uo is a constant.

Figure 6:
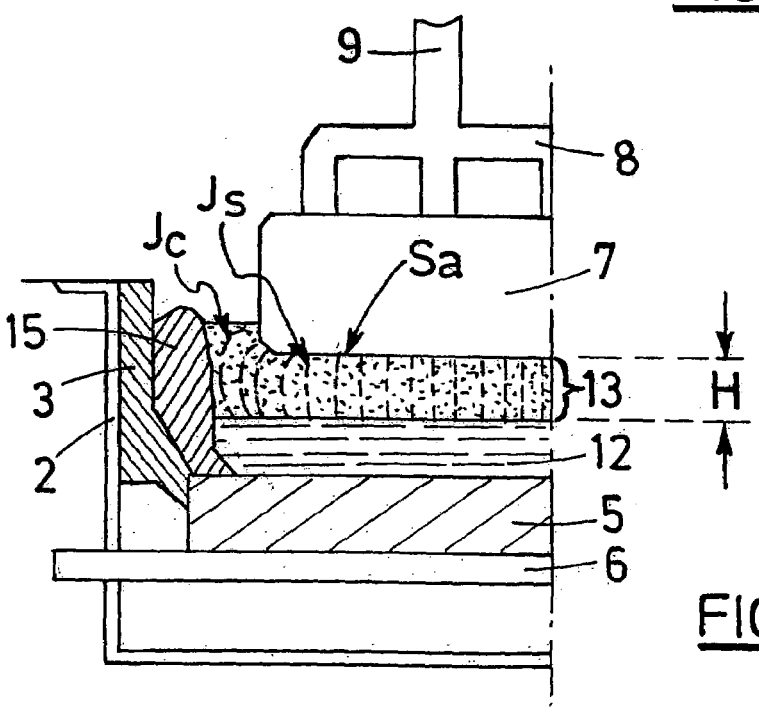
FIG. 6 is a schematic illustration of the shape of the current lines flowing in the electrolyte bath between an anode and the liquid metal pad.

The resistance R depends not only on the resistivity ρ of the electrolyte bath 13, on the distance H between the anode(s) 7 and the liquid metal pad 12, and on the surface area Sa of the anode(s) 7, but also on the spreading η of the lines of current Jc, Js which are established in said bath, particularly between the anode(s) 7 and the solidified bath ridge 15 (lines Jc in FIG. 6). The applicant had the idea to make use of the fact that the specific electric resistance variation ΔRS is not only sensitive to the resistivity of the electrolyte bath, but integrates an electric current spreading factor, which is sensitive to the presence, size and, to a lesser degree, shape of the solidified bath ridge 15 on the walls of the pot.

The applicant also observed that, unlike that which is normally admitted, the spreading η is in fact a preponderant factor in the establishment of electric resistance. The applicant considers that the contribution of spreading to the specific electric resistance variation is typically between 75 and 90%, which means that the contribution of the resistivity is very low, or typically between 10 and 25% (that is typically 15%). In its tests on 500 kA pots, the applicant observed a mean ΔRS value of the order of 100 mΩ/mm, which decreases by approximately −3 nΩ/mm when the bath temperature increases by 5° C. and when the $AlF_3$ content decreases by 1%, and conversely. The contribution of the resistivity to this variation is estimated to be only of the order of −0.5 nΩ/mm (that is only approximately 15% of the total value), the contribution attributable to spreading, i.e. −2.5 nΩ/mm being dominant.

It is possible to take into account the spreading of the current in the resistance measured (for example by modelling the current lines), which improves the reliability of the specific resistance variation considerably as an indication of the variation of the ridge BE (itself an indicator of the thermal state of the cell).

In another preferred embodiment of the invention, the regulation method is characterised in that said at least one ridge variation indicator includes an indicator, referred to as "BM", which is determined from a determination of the surface area S of said liquid metal pad 12.

According to this embodiment of the invention, the regulation method advantageously comprises:

- the determination of a surface area S for the liquid metal pad 12;
- the adjustment of at least one control means and/or at least one control operation using a determined function of the surface area S.

Said adjustment may be a determined function of the so-called "metal surface area" difference between the value obtained for said surface area S and a set-point value So (i.e. S−So).

The surface area S, which corresponds approximately to the metal/bath interface, is approximately equal to the horizontal right section of the electrolytic pot. The presence of solidified electrolyte bath on the walls of the pot decreases this surface area by a quantity which varies as a function of time and pot operating conditions.

Figure 7:
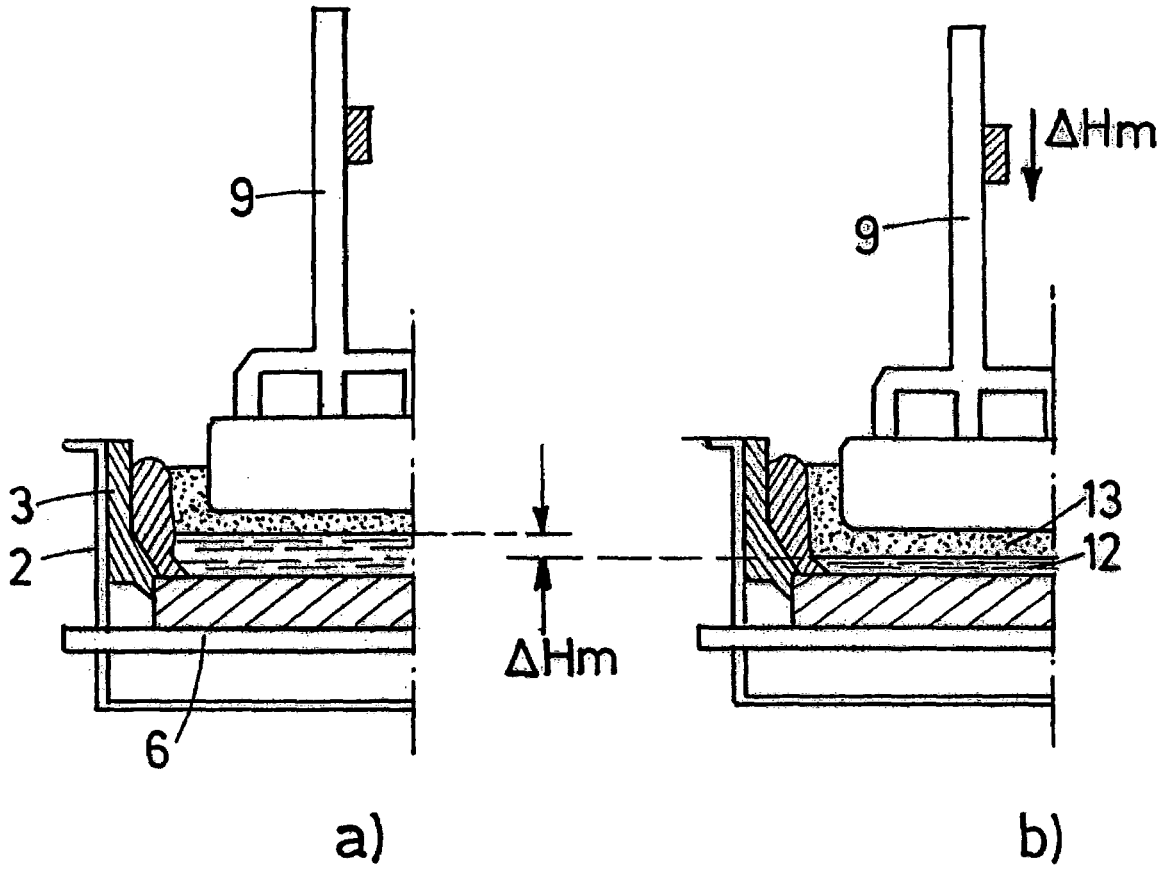
FIG. 7 illustrates a method to determine the surface area of the liquid metal pad.

In the preferred embodiment of this alternative embodiment of the invention, the surface area S is calculated from a measurement of the volume Vm of metal tapped and the corresponding fall ΔHm of the metal level Hm (see FIG. 7). More specifically, said metal surface area may be determined using a measurement method comprising:

- the removal of a quantity of liquid metal from the electrolytic cell;
- the determination of the volume Vm of said quantity of liquid metal removed from the electrolytic cell;
- the determination of the change ΔHm of the resulting level of said liquid metal pad in said pot;
- the determination of a surface area S for said liquid metal pad 12 using the formula S=Vm/ΔHm.

Said volume Vm may be determined by measuring the mass of said quantity of liquid metal removed from the electrolytic cell.

In practice, the anodes 7 are normally lowered at the same time as the level of liquid metal so as to keep the anode/metal distance (AMD) constant.

Said at least one control operation may also comprise at least one addition of solid or liquid electrolyte bath so as to increase the level of said liquid electrolyte bath 13 in said pot 20.

Said adjustments of at least one setting means of the cell and/or at least one control operation may advantageously be combined.

Implementation of the Invention in Bath Acidity Regulation

According to an embodiment of the invention, the regulation method for an electrolytic cell 1 for the production of aluminium by means of electrolytic reduction of alumina dissolved in an electrolyte bath 13 based on cryolite, said cell 1 comprising a pot 20, at least one anode 7, at least one cathode component 5, 6, said pot 20 comprising internal side walls 3 and being capable of containing a liquid electrolyte bath 13, said cell 1 also comprising at least one setting means of said cell including a mobile anode frame 10 to which said at least one anode 7 is attached, said cell 1 being capable of circulating a so-called electrolytic current in said bath, said current having an intensity I, the aluminium produced by said reduction forming a pad referred to as the "liquid metal pad" 12 on the cathode component(s) 5, 6, said cell 1 comprising a solidified bath ridge 15 on said walls 3, comprises control operations of said cell including the addition of alumina and the addition of $AlF_3$ into said bath and is characterised in that it comprises:

- the set-up of a regulation sequence comprising a series of time intervals p of pre-determined length Lp hereafter referred to as "regulation periods" or simply "periods";
- the determination of the value of at least one indicator B referred to as the "ridge variation" capable of detecting the variation of said solidified bath ridge 15;
- the determination of a quantity Qo(p), referred to as the "basic term", corresponding to the net average $AlF_3$ requirements of the cell;
- the determination of a corrective term Qi(p) including at least one term Qsol(p), referred to as the "ridge term", which is determined from at least one or each ridge variation indicator 15;
- the determination of a quantity Q(p) of $AlF_3$ to be added during the period p, referred to as the "determined quantity Q(p)", by adding the corrective term Qi(p) to the basic term Qo(p), i.e. Q(p)=Qo(p)+Qi(p);
- the addition into said electrolyte bath, during the period p, of an effective quantity of aluminium trifluoride ($AlF_3$) equal to said determined quantity Q(p).

The intervals (or "periods") p are preferentially approximately equal in length Lp, i.e. the length Lp of the periods is approximately the same for all the periods, enabling easier implementation of the invention. Said length Lp is generally between 1 and 100 hours.

The term Qsol(p) is a function of variations in the mass of the solidified bath ridge 15 formed on said walls 3; said variations are generally conveyed by variations in the thickness (and, to a lesser degree, the shape) of said ridge.

In an advantageous alternative version of said embodiment of the invention, the term Qsol(p) includes at least one term referred to as Qr(p) which may be determined from at least one electrical measurement on the cell 1 capable of detecting variations in the current lines induced by the variation of said ridge. The term Qr(p) is advantageously determined from at least one measurement of said intensity I and at least one measurement of the drop in voltage U at the terminals of said cell 1.

In the preferred embodiment of this alternative version of the invention, the method comprises:

- the determination of at least one first value I1 for said intensity I and at least one first value U1 for the drop in voltage U at the terminals of said cell 1;
- the calculation of a first resistance R1 from at least said values I1 and U1;
- the movement of the anode frame 10 by a determined distance ΔH, from a so-called initial position, either upwards (ΔH being positive in this case), or downwards (ΔH being negative in this case);
- the determination of at least one second value I2 for said intensity I and at least one second value U2 for the drop in voltage U at the terminals of said cell 1;
- the calculation of a second resistance R2 from at least said values I2 and U2;
- the calculation of a resistance variation ΔR using the formula ΔR=R2 −R1;
- the calculation of said specific resistance ΔRS using the formula ΔRS=ΔR/ΔH;
- the determination of a term Qr(p) using a determined function of said specific resistance variation ΔRS;
- the determination of the corrective term Qi(p) including at least the term Qr(p) in the ridge term Qsol(p).

Preferentially, the measurement method also comprises (at least after the determination of the values of I1, I2, U1 and U2), the movement of the anode frame 10 so as to return it to its initial position and restore the initial cell setting.

Said first and second resistance R1 and R2 may be calculated using the formula R=(U−Uo)/I, where Uo is a constant typically between 1.6 and 2.0 V. For example, R1 and R2 may be given by R1=(U1−Uo)/I1 and R2=(U2−Uo)/I2. According to an alternative embodiment of the invention, R1 and R2 may be given by a mean value obtained from a determined number of values of the voltage U and intensity I.

Figure 3:
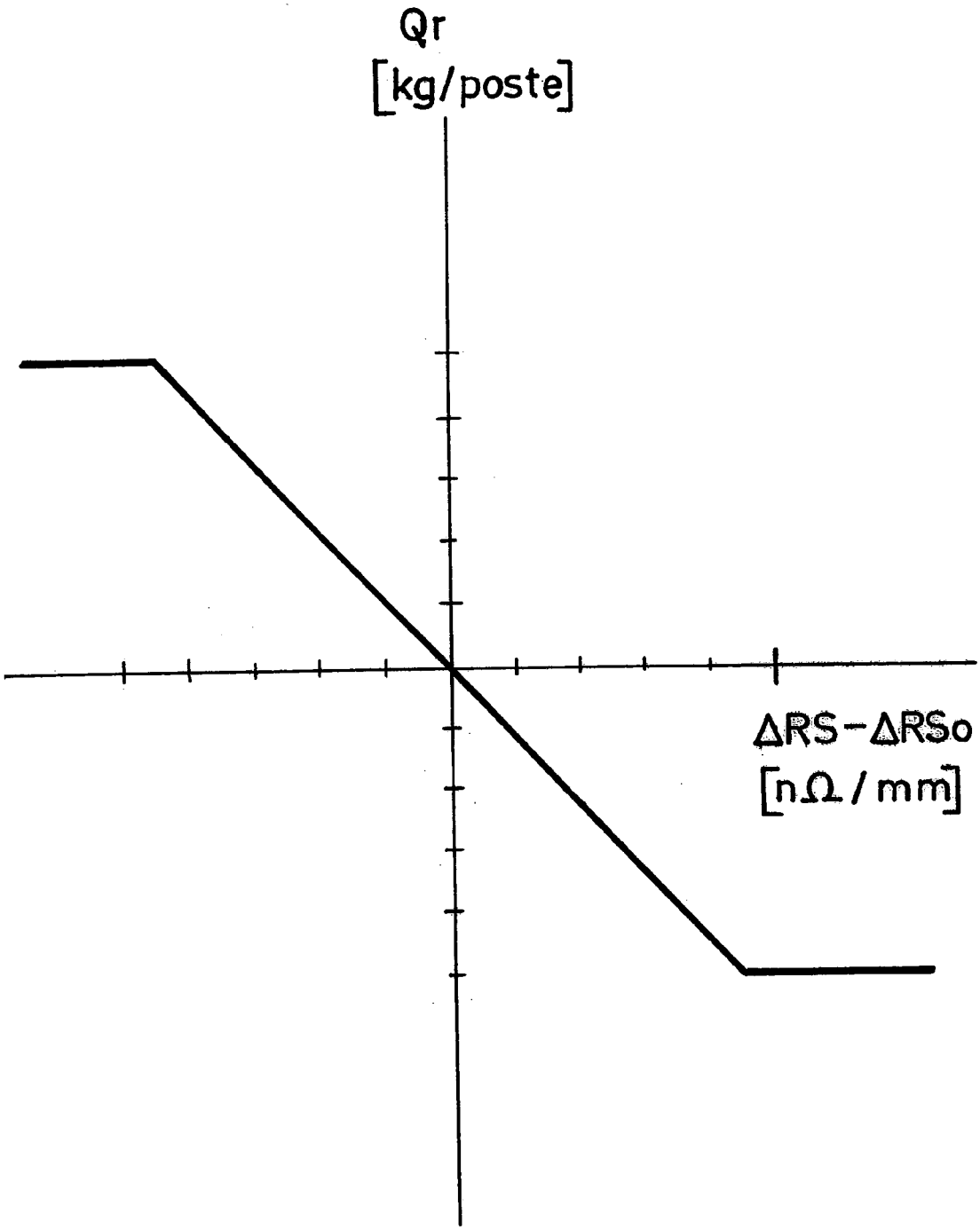
FIGS. 3 and 4 show typical functions used to determine the terms of Q(P).

Said determined function, which is typically decreasing, is preferentially limited. It is advantageously a function of the difference between ΔRS and a reference value ΔRSo. FIG. 3 shows a typical function used to determine the term Qr.

In a simplified alternative embodiment of the invention, the term Qr(p) may be given by a simple equation such as: Qr(p)=Kr×(ΔRS−ΔRSo), where Kr is a constant which may be set empirically and whose value is typically between −0.01 and −10 kg/hour/nΩ/mm, and more typically between −0.05 and −0.3 kg/hour/nΩ/mm (corresponding, in the latter case, to approximately −0.5 to −2 kg/period/nΩ/mm for an 8-hour period) for 300 kA to 500 kA pots.

The term Qr(p) is preferentially limited by a minimum value and by a maximum value. These minimum and maximum values may be negative, null or positive.

In practice, it is possible to make Nr measurements of ΔRS (i.e. two or more measurements) during the period p. The ΔRS value used to calculate Qr(p) will in this case be the mean of the Nr measured ΔRS values, except, if applicable, values considered to be aberrant. It is also possible to use a sliding mean on two or more periods to smooth the thermal fluctuations related to the operating cycle. An operating cycle is determined by the frequency of interventions on the electrolytic cell, particularly anode replacements and liquid metal sampling. The length of an operating cycle is generally between 24 and 48 hours (for example 4×8-hour periods).

In another advantageous alternative embodiment of the method according to the invention, the term Qsol(p) includes at least one term referred to as Qs(p), which may be determined from at least one determination of the surface area S(p) of said liquid metal pad 12. The term Qs(p) is advantageously determined from the so-called "metal surface area" difference between the value obtained for said surface area S(p) and a set-point value So.

According to the preferred embodiment of this alternative version, the method comprises:

- the removal of a quantity of liquid metal from the electrolytic cell;
- the determination of the volume Vm of said quantity of liquid metal removed from the electrolytic cell;
- the determination of the change ΔHm of the resulting level of said liquid metal pad in said pot;
- the determination of a surface area S(p) for said liquid metal pad 12 using the formula S=Vm/ΔHm;
- the determination of a term Qs(p) using a determined function of the surface area S(p) of said liquid metal pad 12;
- the determination of the corrective term Qi(p) including at least the term Qs(p) in the ridge term Qsol(p).

Said volume Vm may be determined by measuring the mass of said quantity of liquid metal removed from the electrolytic cell.

Figure 4:
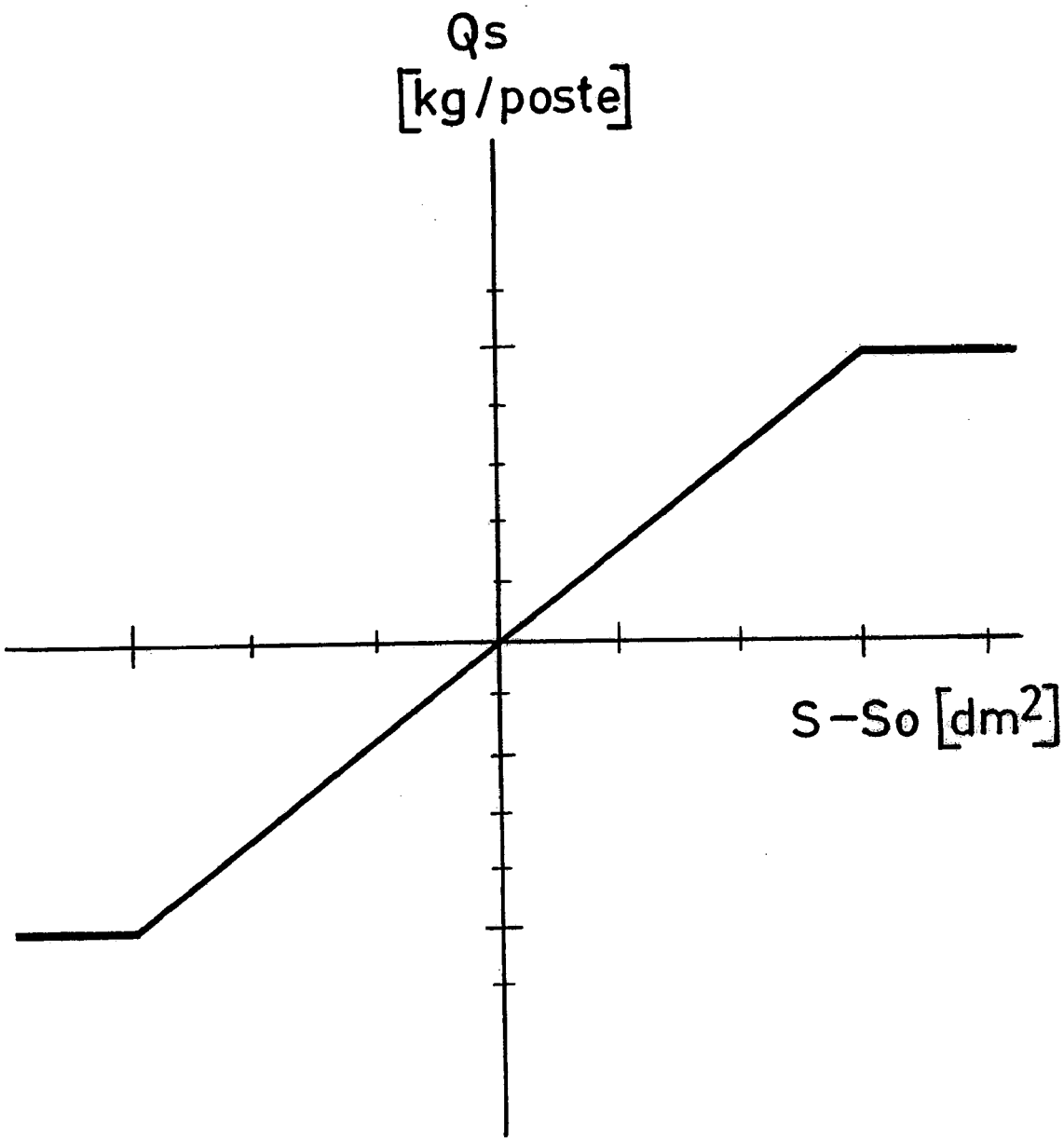

Said determined function, which is typically increasing, is preferentially limited. It is advantageously a function of the difference between the surface area S(p) of the liquid metal pad 12 and a set-point value So. FIG. 4 shows a typical function used to determine the term Qs.

In a simplified alternative embodiment of the invention, the term Qs(p) may be given by a simple equation such as: Qs(p)=Ks×(S(p)−So), where Ks is a constant which may be set empirically and whose value is typically between 0.0001 and 0.1 kg/hour/$dm^2$, and more typically between 0.001 and 0.01 kg/hour/$dm^2$ (corresponding, in the latter case, to approximately 0.01 to 0.05 kg/period/$dm^2$ for an 8-hour period) for 300 kA to 500 kA pots.

The term Qs(p) is preferentially limited by a minimum value and by a maximum value. These minimum and maximum values may be negative, null or positive.

The applicant noted that the corrective terms Qr(p) and Qs(p) according to the present application are effective indicators of the overall thermal state of the electrolytic cell, which take into account both the liquid electrolyte bath and the solidified bath ridge on the walls of the pot. These terms, taken separately or in combination, particularly make it possible to reduce the number of analyses of the $AlF_3$ content in the liquid electrolyte bath markedly. The applicant observed that the frequency of the analyses of the $AlF_3$ content may be reduced typically to one analysis per cell approximately every 30 days. The terms Qr(p) and Qs(p), which may be combined, make it possible to only perform $AlF_3$ content analyses in exceptional cases or in order to characterise a cell or a series of cells statistically. The terms Qr(p) and Qs(p) also enable long-term thermal regulation of the ridge thickness.

In a preferred alternative embodiment of the invention, the basic term Qo(p) is determined using a so-called "integral" (or "self-adaptive") term Qint(p), which represents the total actual $AlF_3$ requirements of the pot. The term Qint(p) is calculated from a mean Qm(p) of the actual $AlF_3$ supplies made during the last N periods. The term Qint(p) takes into account $AlF_3$ losses in the bath occurring during normal cell operation and which are essentially produced by absorption by the pot crucible and emissions in gaseous effluents. This term, the mean value of which is not null, is particularly used to monitor pot ageing, without having to model it, by means of a memory effect of pot behaviour over time. It also takes into account the specific ageing of each pot, that the applicant generally found to be markedly different to the average ageing of the population of pots of the same type.

In this case, the method also comprises:

- the determination of a mean Qm(p) of the total $AlF_3$ additions per period during the last N periods;
- the determination of a quantity Qint(p), advantageously using the following "smoothing" formula: Qint(p)=(1/D)×Qm(p)+(1−1/D)×Qint(p−1), where D is a smoothing parameter setting the temporal smoothing horizon;
- the determination of the basic term Qo(p) using the formula Qo(p)=Qint(p).

The horizon term D, which makes it possible to do away with medium and long-term thermal and chemical fluctuations, is equal to Pc/Lp, where Pc is a period which is typically of the order of 400 to 8000 hours, and more typically from 600 to 4500 hours, and Lp is the length of a period. Therefore, the term D is typically equal to 50 to 1000 8-hour periods if this work organisation method is applied.

The term Qo(p) may be corrected so as to take into account the impact of alumina additions on the effective composition of the electrolyte bath. For this purpose, the method according to the invention may also comprise:

- the determination of a compensating term Qc1(p) corresponding to the so-called "equivalent" quantity of $AlF_3$ contained in the alumina added to the cell during the period p;
- the modification of the term Qo(p) by subtracting the term Qc1(p) from said term Qo(p), i.e. using the formula Qo(p)=Qo(p)−Qc1(p).

The term Qc1(p) corresponds to the so-called "equivalent" quantity of $AlF_3$ added to the cell by means of the alumina added to the electrolytic cell during the period p, where said quantity may be positive or negative. This term is determined by producing the chemical balance of the fluorine and sodium contained in said alumina from one or more chemical analyses. The effect of the sodium contained in the alumina is to neutralise fluorine, thus being equivalent to a negative quantity of $AlF_3$. The term Qlc(p) is positive if said alumina is "fluorinated" (which is the case when it has been used to filter electrolytic cell effluents) and negative if the alumina is "fresh", i.e. if it is produced directly from the Bayer process.

In a preferred alternative embodiment of the invention, the term Qm(p) is calculated using the equation:

$$Qm(p)=\langle Q(p)\rangle+\langle Qc1(p)\rangle, \text{ where}$$

$$\langle Q(p)\rangle=(Q(p-N)+Q(p-N+1)+Q(p-N+2)+\ldots+Q(p-1))/N,$$

$$\langle Qc1(p)\rangle=(Qc1(p-N)+Qc1(p-N+1)+Qc1(p-N+2)+\ldots+Qc1(p-1))/N,$$

where N is a constant.

The term Qm(p) is then equal to Q(p−1)+Qc1(p−1) when N=1; (Q(p−2)+Qc1(p−2)+Q(p−1)+Qc1(p−1))/2 when N=2; (Q(p−3)+Qc1(p−3) +Q(p−2)+Qc1(p−2)+Q(p−1)+Qc1(p−1))/3 when N=3, . . .

The value of the parameter N is selected according to the cell reaction time and is normally between 1 and 100, and more typically between 1 and 20.

The term Qm(p) then takes into account total equivalent $AlF_3$ supplies, i.e. "direct" supplies from additions of $AlF_3$ and "indirect" supplies from additions of alumina.

In another advantageous alternative embodiment of the invention, the determination of Qi(p) comprises an additional so-call "damping" corrective term Qc2(p), which takes into account the delay in the reaction of the cell with the $AlF_3$ additions. The term Qc2 is a prospective correction term which is used to take into account the effect of an addition of $AlF_3$ in advance, which normally only appears after a few days. Indeed, the applicant noted the surprising degree of the difference between the time constant of the temperature variation, which is low (of the order of a few hours) and that of the $AlF_3$ content, which is very high (of the order of a few tens of hours). In its tests, it found that it was very advantageous to anticipate the variation of the acidity of the bath of the cell when adding $AlF_3$, which is made possible effectively by the term Qc2.

This alternative embodiment may be implemented by including in the method according to the invention:

- the determination of an additional corrective term Qc2(p) using a typically decreasing, preferentially limited, function of the difference between Qm(p) and Qint(p), i.e. Qm(p)−Qint(p);
- the addition of the corrective term Qc2(p) in the determination of Qi(p).

In a simplified alternative embodiment of the invention, the term Qc2(p) may follow a simple equation, such as Qc2(p)=Kc2×(Qm(p)−Qint(p)), where Kc2 is a constant which is typically negative and which may be set empirically and whose value is typically between −0.1 and −1, and more typically between −0.5 and −1 for 300 kA to 500 kA pots.

The term Qc2(p) is preferentially limited by a minimum value and by a maximum value. These minimum and maximum values may be negative, null or positive.

In order to converge the integral term Qint(p) rapidly to the quantity Q' corresponding to actual cell requirements, it is possible to start the method by simply taking Qint(0) =Qtheo, where Qtheo corresponds to the total theoretical $AlF_3$ requirements of the cell when regulation is started. The $AlF_3$ requirements of an electrolytic cell are essentially due to losses through absorption in the walls of the pot and emission of fluorinated products. Qtheo is a function of the age of the pot which can be determined statistically for each type of cell.

This alternative embodiment may be implemented by including in the method according to the invention:

- the determination of a quantity Qtheo corresponding to the total theoretical $AlF_3$ requirements of the cell when regulation is started;
- the start-up of the method by taking Qint(0)=Qtheo.

Figure 8:
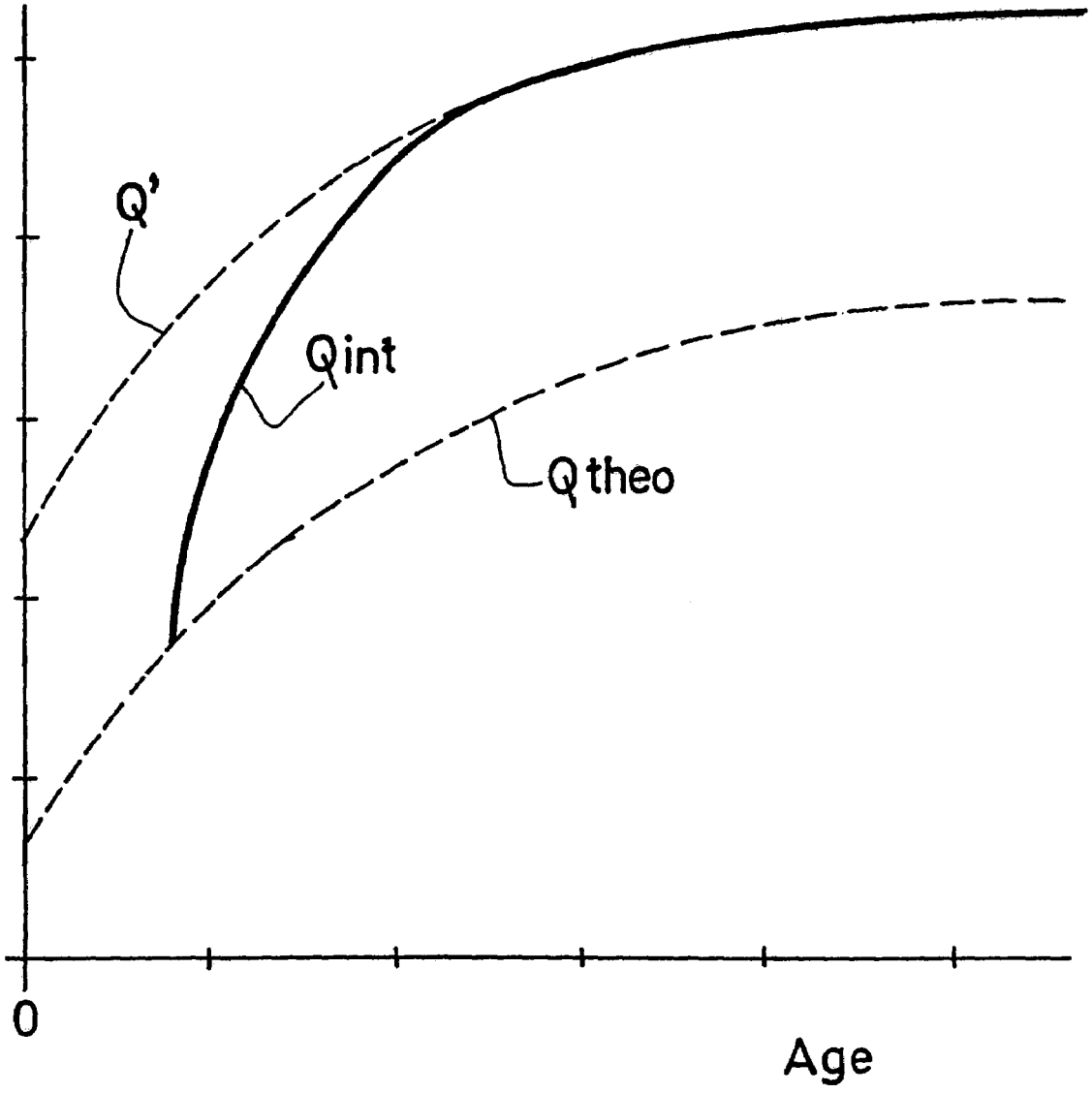
FIG. 8 shows the variations in total $AlF_3$ requirements of an electrolytic cell.

FIG. 8 illustrates, using typical values, the term Qtheo(p) and the operating principle of the integral term Qint(p).

In another advantageous alternative embodiment of the invention, the determination of Qi(p) includes an additional corrective term Qt(p) which is a function of the bath temperature measured of the electrolyte bath. The term Qt(p) also makes it possible to avoid having to use regular bath $AlF_3$ content measurements.

This alternative embodiment may be implemented by including in the method according to the invention:

- the determination of a mean temperature T(p) of the electrolyte bath;
- the determination of an additional corrective term Qt(p) using a determined function, which is typically increasing and preferentially limited (i.e. it is limited by a maximum value and by a minimum value), of the difference between said temperature T(p) and a set-point temperature To;
- the addition of the corrective term Qt(p) in the determination of Qi(p).

In a simplified alternative embodiment of the invention, the term Qt(p) may follow a simple equation, such as Qt(p)=Kt×(T(p)−To), where Kt is a constant which is typically positive and which may be set empirically and whose value is typically between 0.01 and 1 kg/hour/° C., and more typically between 0.1 and 0.3 kg/hour/° C. (corresponding, in the latter case, to approximately 1 to 2 kg/period/° C. for an 8-hour period) for 300 kA to 500 kA pots.

The term Qt(p) is preferentially limited by a minimum value and by a maximum value. These minimum and maximum values may be negative, null or positive.

The mean temperature T(p) is normally determined from temperature measurements made on the period p and on the previous periods p−1, etc., so as to obtain a reliable and significant value of the average condition of the pot.

The terms Qt(p) and Qc2(p) are regulation terms wherein the mean value over time normally tends towards zero (i.e. they are normally null on average).

In another advantageous alternative embodiment of the invention, the quantity Qi(p) comprises an additional corrective term Qe(p) which is a function of the difference between the excess $AlF_3$ measured E(p) and its target value Eo.

This alternative embodiment may be implemented by including in the method according to the invention:

- the measurement of the excess $AlF_3$ E(p);
- the determination of an additional corrective term Qe(p) using a determined function (typically decreasing and preferentially limited) of the difference between the excess $AlF_3$ measured E(p) and its target value Eo, i.e. the difference E(p)−Eo;
- the addition of the term Qe(p) in the determination of Qi(p).

In a simplified alternative embodiment of the invention, the term Qe(p) may be given by a simple equation such as: Qe(p)=Ke×(E(p)−Eo), where Ke is a constant which may be set empirically and whose value is typically between −0.05 and −5 kg/hour/% $AlF_3$, and more typically between −0.5 and −3 kg/hour/% $AlF_3$ (corresponding, in the latter case, to approximately −20 to −5 kg/period/% $AlF_3$ for an 8-hour period) for 300 kA to 500 kA pots.

The term Qe(p) is preferentially limited by a minimum value and by a maximum value. These minimum and maximum values may be negative, null or positive.

The applicant found it was satisfactory to only apply the term Qe(p) exceptionally, for a short length of time, when the thermal operation of the cell leaves the normal operating range, i.e. when the temperature values and values of the regulation terms (Qr, Qs, etc.) leave the so-called safety ranges.

The applicant noted in its tests that the corrective term Qe enabled the indicators (temperature, Qr, Qs, etc.) to return rapidly to the normal operating range.

According to another alternative embodiment of the invention, it is also possible to add corrective terms to take into account individual interfering events.

In particular, the corrective term Qi(p) may comprise a so-called anode effect term Qea to take into account the impact of an anode effect on the thermics of an electrolytic cell. An anode effect particularly induces significant $AlF_3$ losses by emission and, generally, heating of the electrolyte bath. The term Qea is applied for a limited time following the observation of an anode effect. The term Qea is calculated using either a scale which is a function of the anode effect energy (AEE), or a fixed mean value. In the first case, the term Qea is given by a typically increasing and preferentially limited function of the energy AEE.

The term Qea(p) is preferentially limited by a minimum value and by a maximum value. These minimum and maximum values may be negative, null or positive.

The term Q(p) corresponds to an addition of pure $AlF_3$ and is typically expressed in kg of pure $AlF_3$ per period (kg/period). The expression "addition of an effective quantity of $AlF_3$" corresponds to an addition of pure $AlF_3$. In industrial practice, $AlF_3$ additions are generally made using so-called industrial $AlF_3$ with a purity of less than 100% (typically 90%). In this case, a sufficient quantity of industrial $AlF_3$ is added to obtain the effective quantity of $AlF_3$ required. Typically, a quantity of industrial $AlF_3$ equal to the effective quantity of $AlF_3$ required divided by the purity of the industrial $AlF_3$ used is added.

The expression "total $AlF_3$ additions" refers to the sum of the effective additions of pure $AlF_3$ and the "equivalent" $AlF_3$ additions from alumina.

$AlF_3$ may be added in different ways. It may be added manually or mechanically (preferentially using a a point feed, such as an crustbreaker-feeder which makes it possible to add determined doses of $AlF_3$, in an automated fashion if required). $AlF_3$ may be added with alumina or at the same time as alumina.

Industrial bath and pure cryolite additions are sometimes performed on industrial cells. These additions have an impact on the composition of the electrolyte bath which must generally be taken into account in the regulation. For this purpose, the regulation method may also comprise a corrective term Qb to take into account the modification of the pure $AlF_3$ content induced by these additions.

The different terms of Q(p) are determined preferentially at each period p. If the cell is very stable, it may be sufficient to determine the quantity Q(p) and some of the terms forming it, in a more staggered manner over time, for example once every two or three periods. The applicant observed that it was sufficient to only apply some of the terms of Q(p), such as Qe(p), exceptionally and for a limited length of time, which makes it possible to limit costs relating to their determination.

In order to prevent excess $AlF_3$ additions, it is preferable, as a precaution, to limit Q(p) to a maximum value Qmax. It is also preferable to limit the application of the regulation terms in time when they cannot be determined at each period.

The quantity Q(p) is normally determined at each period. If one or more terms of Q(p) cannot be calculated during a given period, then it is possible to maintain the value of said term(s) used during the previous period, i.e. the value of said term(s) will be determined by making it equal to the value used during the previous period. If one or more terms cannot be calculated during several periods, then it is possible to retain the value of said term(s) used during the last period for which it could be calculated and maintain this value for a limited number Ns of periods (Ns being typically equal to 2 or 3). In the latter case, if said term(s) still cannot be calculated after the Ns periods, then it is possible retain the pre-determined fixed value, referred to as the "standby value". These different situations may occur, for example, when the mean temperature of the pot cannot be determined or when the equivalent $AlF_3$ quantity contained in the alumina could not be determined.

The term Q(p) may be positive, null or negative. In the last case, it is assumed that Q(p)=0, i.e. $AlF_3$ is not added during the period p. When the term Q(p) is negative, it is also possible to correct the composition of the electrolyte bath 13 by adding soda, i.e. calcined soda or sodium carbonate, referred to as soda ash.

Figure 2:
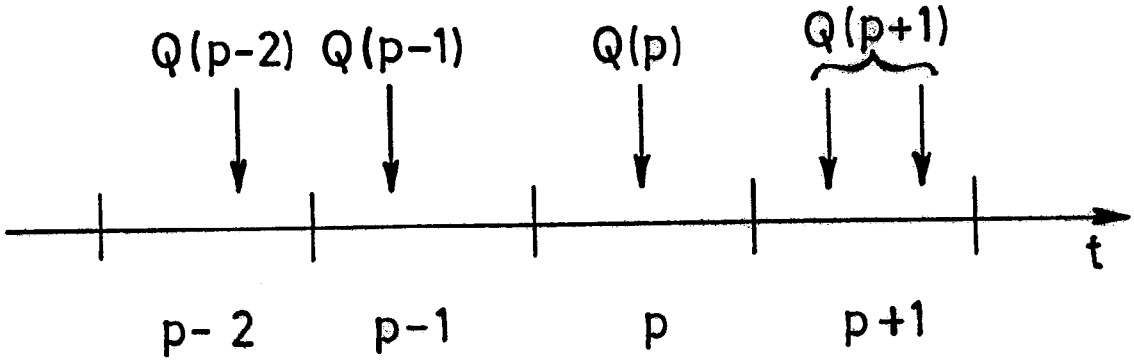
FIG. 2 illustrates the principle of the regulation sequences according to the invention.

As shown in FIG. 2, the additions of $AlF_3$ may be made at any time during said regulation periods (or sequences), which may correspond to the work shifts which determine the frequency of the changes of the shifts in charge of cell control and maintenance. The quantity Q(p) of $AlF_3$ determined for a period p may be added in one or more times during said working period. Preferentially, the quantity Q(p) is added practically continuously using crustbreaker-feeders which make it possible to add predetermined doses of $AlF_3$ throughout the period p.

EXAMPLES OF EMBODIMENTS OF THE INVENTION

The following examples illustrate the calculations inherent to the regulation method according to the invention. These calculations are typical of those made for the 500 kA cells tested by the applicant. The length of the periods is 8 hours.

Example 1

Example illustrating the use of the additional terms Qr and Qs in combination with the basic terms Qint, Qc1, Qc2 and Qsol.

The value of Qtheo at 28 months is +31 kg/period. The average requirements of the pot Q' determined by the integral term Qint are +39 kg/period.

The alumina analysis gives a value of 1.36% fluorine and 5250 ppm of $Na_2O$ equivalent. The term Qc1 is then equal to +22 kg/period in equivalent pure $AlF_3$ supply.

By taking N=12, the total actual $AlF_3$ supplies per period over the last N periods is 44 kg/period. The difference between the actual supplies (44 kg/period) and the mean requirements (39 kg/period) is then +5 kg/period. The term Qc2 is then equal to −3 kg/period.

The temperature measured is 964° C. and the set-point temperature 953° C., i.e. a difference of +10.8° C. The corrective term Qt is then equal to +18 kg/period.

The ΔRS value measured is 101.8 nΩ/mm and the set-point value ΔRSo is 106.0 nΩ/mm. The term Qr(p) is then equal to +5 kg/period.

The S value measured is 6985 $dm^2$ and the set-point value So is 6700 $dm^2$. The term Qs(p) is then equal to +5 kg/period.

The quantity of $AlF_3$ to be added during the period p is then equal to: Q(p)=Qint(p)−Qc1(p)+Qc2(p)+Qt(p)+Qr(p)+Qs(p)=39−22−3+18+5+5=+42 kg. The terms Qr and Qs make a significant correction to the quantity Q(p).

Tests

The method according to the invention was used to regulate electrolytic cells with intensities of up to 500 kA. The length of the periods was 8 hours.

The tests related to different types of pots. Table I contains the characteristics of some of the electrolytic cells placed under test and the typical results obtained. In case A, the pots were regulated using the embodiment of the invention wherein Q(p) was determined using the terms Qint(p), Qc1(p), Qc2(p) and Qt(p). In case B, the pots were regulated using the embodiment of the invention wherein Q(p) was determined using the terms Qint(p), Qc1(p), Qc2(p), Qt(p) and Qe(p). In case C, the pots were regulated using the embodiment of the invention wherein Q(p) was determined using the terms Qint(p), Qc1 (p), Qc2(p), Qt(p), Qr(p) and Qs(p).

TABLE 1

| | Case A | Case B | Case C |
|---|---|---|---|
| Intensity (kA) | 300 kA | 330 kA | 500 kA |
| Anode density (A/cm$^2$) | 0.78 | 0.85 | 0.90 |
| Liquid bath mass (kg/kA) | 25 | 22 | 17 |
| Excess $AlF_3$ (%) | 11.8 | 11.8 | 13.2 |
| Total standard deviation (σ %) | 1.5 | 1.3 | 1.3 |
| Dispersion of excess $AlF_3$ at ±2 σ % | 8.8–14.8 | 9.2–14.4 | 10.6–15.8 |
| Bath temperature (° C.) | 962 | 962 | 961 |
| Total standard deviation (σ %) | 6 | 6 | 3.5 |
| Dispersion of temperature at ±2 σ % | 950–974 | 950–974 | 954–968 |
| Current efficiency (%) | 95.0 | 95.0 | 95.5 |

The results show that the regulation method according to the invention makes it possible to regulate electrolytic cells effectively wherein the excess $AlF_3$ of the bath is greater than 11% and wherein the bath temperature is in the vicinity of 960° C. Accounting for the terms Qr(p) and Qs(p) in the determination of Q(p) makes it possible to regulate effectively, and with a surprising stability, electrolytic cells wherein the intensity and anode density are very high and wherein the liquid bath mass is low.

The applicant observed during its tests that the regulation method according to the invention makes it possible to control, with high stability, the $AlF_3$ content of electrolytic cells, over a period of several months, without having to take into account measured $AlF_3$ contents, said measured contents are, in any case, easily affected by significant errors.

The invention claimed is:

1. Regulation method for an electrolytic cell for the production of aluminum by means of electrolytic reduction of alumina dissolved in an electrolyte bath based on cryolite, said cell comprising a pot, at least one anode, at least one cathode component, said pot comprising internal side walls and being capable of containing a liquid electrolyte bath, said cell comprising at least one means to set said cell including a mobile anode frame to which said at least one anode is attached, said cell being capable of circulating an electrolytic current in said bath, said current having an intensity I, the aluminum produced by means of said reduction forming a liquid metal pad on said cathode component, said cell comprising a solidified bath ridge on said walls, wherein said regulation method comprises:

determining a value of at least one indicator B by making a measurement of at least one variation of said ridge and wherein said indicator B correlates to said variation, and adjusting operating parameters to control overall thermics of said electrolytic cell using the value determined for indicator B as a basis for making adjustment to said parameters.

2. Regulation method according to claim 1, wherein said measurement comprises making at least one electrical measurement on said cell to detect variations of the current lines induced by the variation of said ridge.

3. Regulation method according to claim 2, wherein said electrical measurement is conducted by determining an intensity I and of the drop in voltage U at the terminals of said cell.

4. Regulation method according to claim 3, wherein said electrical measurement comprises determining a specific resistance variation ΔRS by determining at least one first value I1 for said intensity I and at least one first value U1 for the drop in voltage U at the terminals of said cell;

calculating a first resistance Ri from at least said values I1 and U1;

moving the anode frame by a determined distance ΔH, from an initial position, either upwards, or downwards;

determining at least one second value I2 for said intensity I and at least one second value U2 for the drop in voltage U at the terminals of said cell;

calculating a second resistance R2 from at least said values I2 and U2;

calculating a resistance variation ΔR using the formula ΔR=R2−R1;

calculating said specific resistance ΔRS using the formula ΔRS =ΔR/ΔH.

5. Regulation method according to claim 4, wherein the measurement method also comprises, at least after the determination of the values of I1, I2 U1 and U2, moving the anode frame so as to return it to an initial position and restore an initial cell setting.

6. Regulation method according to claim 5, wherein said first and second resistance are calculated using the formula R=(U−Uo)/I, where Uo is a constant.

7. Regulation method according to claim 6, wherein the constant Uo is from 1.6 to 2.0 V.

8. Regulation method according to claim 4, wherein said adjusting using said indicator B further comprises calculating the difference between said specific resistance variation ΔRS and a predetermined reference value ΔRSo in order to optimize adjustment of said pot functions.

9. Regulation method according to claim 1, wherein said measurement comprises determining the surface area S of said liquid metal pad to define the value of said indicator B.

10. Regulation method according to claim 9, wherein said surface area is determined by:

removing a quantity of liquid metal from the electrolytic cell;

determining the volume Vm of said quantity of liquid metal removed from the electrolytic cell;

determining the change ΔHm of the resulting level of said liquid metal pad in said pot;

determining a surface area S for said liquid metal pad using the formula S =Vm/ΔHm.

11. Regulation method according to claim 10, wherein said volume Vm is determined by measuring the mass of said quantity of liquid metal removed from the electrolytic cell.

12. Regulation method according to claim 9, wherein said adjusting further comprises determining the difference between the value obtained for said surface area S and a set-point value So.

13. Regulation method according to claim 1, wherein said adjusting comprises modifying the position of said mobile anode frame, either upwards, or downwards, so as to modify the anode/metal distance.

14. Regulation method according to claim 1, wherein said adjusting comprises adding solid or liquid electrolyte bath so as to increase the level of said liquid electrolyte bath in said pot.

15. Regulation method according to claim 1, wherein said adjusting comprises modifying said $AlF_3$ addition.

16. A regulation method as claimed in claim 1, wherein said adjusting operating parameters reduces the amplitude and dispersion of fluctuations of said parameters such that the cell has a current efficiency of at least about 93%.

17. A regulation method as claimed in claim 1, wherein said adjusting operating parameters comprises one or more of the following (i) changing the quantity of alumina and/or $AlF_3$ being added to said bath, (ii) modifying the position of said mobile anode frame, either upwards, or downwards, so as to modify the anode/metal distance, and/or (iii) adding solid or liquid electrolyte bath to said cell.

18. A regulation method as claimed in claim 1, wherein said at least one variation of said ridge comprises a variation in the thickness and/or a variation in the shape of said ridge.

19. A regulation method for an electrolytic cell for the production of aluminum by means of electrolytic reduction of alumina dissolved in an electrolyte bath based on cryolite, said cell comprising a pot, at least one anode, at least one cathode component, said pot comprising internal side walls and being capable of containing a liquid electrolyte bath, said cell also comprising at least one means to set said cell including a mobile anode frame to which said at least one anode is attached, said cell being capable of circulating an electrolytic current in said bath, said current having an intensity I, the aluminum produced by said reduction forming a liquid metal pad on the cathode component, said cell comprising a solidified bath ridge on said walls, said method comprising:

setting up a regulation sequence comprising a series of time intervals of pre-determined length Lp;

determining the value of at least one indicator B by measuring at least one variation of said solidified bath ridge such that said indicator B correlates to said variation;

determining a quantity Qo(p), corresponding to the net average $AlF_3$ requirements of the cell;

determining a corrective term Qi(p) including at least one term Qsol(p), which is determined from said indicator B;

determining a quantity Q(p) of $AlF_3$ to be added during the period p, by adding the corrective term Qi(p) to the basic term Qo(p) such that Q(p)=Qo(p)+Qi(p);

adding into said electrolyte bath, during the period p, of an effective quantity of $AlF_3$ equal to said determined quantity Q(p).

20. Regulation method according to claim 19 wherein said length Lp of said periods is approximately the same for all the periods.

21. Regulation method according to claim 19, wherein said length Lp of each of said periods is from 1 to 100 hours.

22. Regulation method according to claim 19, wherein the term Qsol(p) comprises at least one term Qr(p) which is determined from at least one electrical measurement on said cell capable of detecting variations in the current lines induced by the variation of said ridge.

23. Regulation method according to claim 22, wherein the term Qr(p) is determined from at least one measurement of said intensity I and at least one measurement of the drop in voltage U at the terminals of said cell.

24. Regulation method according to claim 23, wherein said method further comprises:

determining at least one first value I1 for said intensity I and at least one first value U1 for the drop in voltage U at the terminals of said cell;

calculating a first resistance R1 from at least said values I1 and U1;

moving the anode frame by a determined distance ΔH, from an initial position, either upwards, or downwards;

determining at least one second value I2 for said intensity I and at least one second value U2 for the drop in voltage U at the terminals of said cell;

calculating a second resistance R2 from at least said values I2 and U2;

calculating a resistance variation ΔR using the formula ΔR =R2−R1;

calculating a specific resistance variation ΔRS using the formula ΔRS=ΔR/ΔH;

determining a term Qr(p) based on said specific resistance variation ΔRS;

determining a corrective term Qi(p) including at least the term Qr(p) in the ridge term Qsol(p).

25. Regulation method according to claim 24, wherein said method further comprises, at least after the determination of the values of I1, I2 U1 and U2, the movement of the anode frame so as to return it to an initial position and restore an initial cell setting.

26. Regulation method according to claim 24, wherein said first and second resistance are calculated using the formula R=(U−Uo)/I, where Uo is a constant.

27. Method according to claim 26, wherein the constant Uo is between 1.6 and 2.0 V.

28. Regulation method according to claim 24, wherein the term Qr(p) is given by the function Qr(p)=Kr×(ΔRS−ΔRSo), where Kr is a constant and ΔRSo is a reference value.

29. Regulation method according to claim 28, wherein Kr is between −0.01 and −10 kg/hour/nΩ/mm.

30. Regulation method according to claim 24, wherein the term Qr(p) is limited by a minimum value and by a maximum value.

31. Regulation method according to claim 19, wherein the term Qsol(p) comprises at least one term Qs(p) which is determined from at least one determination of the surface area S(p) of said liquid metal pad.

32. Regulation method according to claim 31, wherein said method further comprises:

removing a quantity of liquid metal from the electrolytic cell;

determining the volume Vm of said quantity of liquid metal removed from the electrolytic cell;

determining the change ΔHm of the resulting level of said liquid metal pad in said pot;

determining a surface area S for said liquid metal pad using the formula S=Vm/ΔHm;

determining a term Qs(p) using a determined function of the surface area S(p) of said liquid metal pad;

determining a corrective term Qi(p) including at least the term Qs(p) in the ridge term Qsol(p).

33. Regulation method according to claim 32, wherein said volume Vm is determined by measuring the mass of said quantity of liquid metal removed from the electrolytic cell.

34. Regulation method according to claim 32, wherein the term Qs(p) is determined from the metal surface area difference between the value obtained for said surface area S and a set-point value So.

35. Regulation method according to claim 32, wherein the term Qs(p) is given by the function Qs(p)=Ks×S(p)−So), where Ks is a constant.

36. Regulation method according to claim 35, wherein Ks is between 0.0001 and 0.1 kg/hour/$dm_2$.

37. Regulation method according to claim 32, wherein the term Qs(p) is limited by a minimum value and by a maximum value.

38. Regulation method according to claim 19, wherein said method further comprises:

determining a mean Qm(p) of the total $AlF_3$ additions per period during the last N periods;

determining a quantity Qint(p), using the following formula: Qint(p)=(1/D)×Qm(p)+(1−1/D)×Qint(p−1), where D is a smoothing parameter setting the temporal smoothing horizon;

determining the basic term Qo(p) using the formula Qo(p)=Qint(p).

39. Regulation method according to claim 38, wherein said method further comprises:

determining a compensating term Qc1(p) corresponding to an equivalent quantity of $AlF_3$ contained in the alumina added to the cell during the period p;

modifying the term Qo(p) by subtracting the term Qc1(p) from said term Qo(p) using the formula Qo(p)=Qo(p) Qc1(p).

40. Regulation method according to claim 39, wherein the term Qm(p) is given by the equation:

$$Qm(p)=\langle Q(p)\rangle+\langle Qc1(p)\rangle, \text{ where}$$

$$\langle Q(p)\rangle=(Q(p-N)+Q(p-N+1)+Q(p-N+2)+\ldots+Q(p-1))/N,$$

$$\langle Qc1(p)\rangle=(Qc1(p-N)+Qc1(p-N+1)+Qc1(p-N+2)+\ldots+Qc1(p-1))/N,$$

where N is a constant.

41. Regulation method according to claim 40, wherein N is between 1 and 100.

42. Regulation method according to claim 38, wherein the parameter D is equal to Pc/Lp, where Pc is between 400 and 8000 hours.

43. Method according to claim 38, wherein said method further comprises:

determining a quantity Qtheo corresponding to the total theoretical $AlF_3$ requirements of the cell when regulation is started;

initiating the method by taking Qint(0)=Qtheo.

44. Regulation method according to claim 38, wherein it comprises:

the determination of an additional corrective term Qc2(p) using a function of the difference between Qm(p) and Qint(p);

the addition of the term Qc2(p) in the determination of Qi(p).

45. Regulation method according to claim 44, wherein the term Qc2(p) is given by the formula Qc2(p)=Kc2×(Qm(p)−Qint(p)), where Kc2is a constant.

46. Regulation method according to claim 45, wherein Kc2 is between −0.1 and −1.

47. Regulation method according to claim 44, wherein the term Qc2(p) is limited by a minimum value and by a maximum value.

48. Regulation method according to claim 19, wherein said method further comprises:

determining a mean temperature T(p) of the electrolyte bath;

determining an additional corrective term Qt(p) using a determined function of the difference between said temperature T(p) and a set-point temperature To;

adding the corrective term Qt(p) in the determination of Qi(p).

49. Regulation method according to claim 48, wherein the term Qt(p) is given by the formula Qt(p)=Kit×(T(p)−To), where Kt is a constant.

50. Regulation method according to claim 49, wherein Kt is between 0.01 and 1 kg/hour/° C.

51. Regulation method according to claim 48, wherein the term Qt(p) is limited by a minimum value and by a maximum value.

52. Regulation method according to claim 19, wherein said method further comprises:

determining a value corresponding to excess $AlF_3$ E(p);

determining an additional corrective term Qe(p) using a function of the difference between the excess $AlF_3$ measured E(p) and its target value Eo;

adding the corrective term Qe(p) in the determination of Qi(p).

53. Regulation method according to claim 52, wherein the term Qe(p) is given by the formula Qe(p)=Ke×(E(p)−Eo), where Ke is a constant.

54. Regulation method according to claim 53, wherein Ke is between −0.05 and −5 kg/hour/%$AlF_3$.

55. Regulation method according to claim 52, wherein the term Qe(p) is limited by a minimum value and by a maximum value.

56. Regulation method according to claim 19, wherein the quantity Q(p) comprises an additional term Qea(p) which is given by a function of the anode effect energy AEE.

57. Regulation method according to claim 56, wherein the term Qea(p) is limited by a minimum value and by a maximum value.

58. Regulation method according to claim 19, wherein the quantity Q(p) is limited to a maximum quantity Qmax.

59. Regulation method according to claim 19, wherein, when the determined value of the term Q(p) is negative, a value thereof is taken as equal to zero and no $AlF_3$ is added during the period p.

* * * * *

UNITED STATES PATENT AND TRADEMARK OFFICE

CERTIFICATE OF CORRECTION

PATENT NO. : 7,192,511 B2
APPLICATION NO. : 10/467483
DATED : March 20, 2007
INVENTOR(S) : Oliver Bonnardel and Claude Vanvoren It is certified that error appears in the above-identified patent and that said Letters Patent is hereby corrected as shown below:

Claim 3, Column 15, line 64, after "and" delete "of".

Claim 4, Column 16, line 4, delete "Ri" and insert --R1--

Claim 35, Column 18, line 57, delete "Ks x S(p) - So)" and insert --Ks x (S(p) - So)--; line 60, delete "$dm_2$" and insert --$dm^2$--

Signed and Sealed this

Twenty-sixth Day of June, 2007

JON W. DUDAS
*Director of the United States Patent and Trademark Office*